US011338471B2

(12) United States Patent
Miyazawa et al.

(10) Patent No.: US 11,338,471 B2
(45) Date of Patent: May 24, 2022

(54) SHEET MANUFACTURING APPARATUS

(71) Applicant: SEIKO EPSON CORPORATION, Tokyo (JP)

(72) Inventors: Kazuma Miyazawa, Nagano (JP); Toshiaki Yamagami, Nagano (JP); Masahide Nakamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 951 days.

(21) Appl. No.: 15/998,938

(22) PCT Filed: Jan. 24, 2017

(86) PCT No.: PCT/JP2017/002331
§ 371 (c)(1),
(2) Date: Aug. 17, 2018

(87) PCT Pub. No.: WO2017/141642
PCT Pub. Date: Aug. 24, 2017

(65) Prior Publication Data

US 2021/0206019 A1 Jul. 8, 2021

(30) Foreign Application Priority Data

Feb. 18, 2016 (JP) ..... JP2016-029094

(51) Int. Cl.
*B27N 3/04* (2006.01)
*B27N 3/18* (2006.01)
(Continued)

(52) U.S. Cl.
CPC ..... *B27N 3/18* (2013.01); *B27N 3/04* (2013.01); *D04H 1/72* (2013.01); *D21B 1/063* (2013.01); *D21F 11/00* (2013.01)

(58) Field of Classification Search
CPC . B27N 1/02; B27N 3/007; B27N 3/04; B27N 3/08; B27N 3/18; B27N 3/183;
(Continued)

(56) References Cited

U.S. PATENT DOCUMENTS 5,871,160 A * 2/1999 Dwyer, III ..... D21B 1/08 241/5
2015/0096701 A1* 4/2015 Higuchi ..... D21D 5/18 162/261
(Continued)

FOREIGN PATENT DOCUMENTS

JP 2012-007246 A 1/2012
JP 2013-023788 A 2/2013
(Continued)

OTHER PUBLICATIONS

The Partial Supplementary European Search Report for the corresponding European Patent Application No. 17752906.2 dated Dec. 2, 2019.

*Primary Examiner* — Michael A Tolin
(74) *Attorney, Agent, or Firm* — Global IP Counselors, LLP

(57) ABSTRACT

A sheet manufacturing apparatus includes a coarse crushing portion that crushes a raw material containing a fiber into coarse crushed pieces, a defibrating portion that defibrates the coarse crushed pieces into a defibrated material, a sieve portion that includes a plurality of openings, a sheet forming portion that uses the defibrated material passing through the opening of the sieve portion to form a sheet, and a transport passage that transports the defibrated material, which has not passed through the opening of the sieve portion, between the coarse crushing portion and the defibrating portion.

6 Claims, 8 Drawing Sheets

(51) Int. Cl.
*D04H 1/72* (2012.01)
*D21B 1/06* (2006.01)
*D21F 11/00* (2006.01)

(58) Field of Classification Search
CPC D04H 1/26; D04H 1/425; D04H 1/60; D04H 1/72; D04H 1/732; D04H 1/736; D21B 1/06; D21B 1/063; D21B 1/08; D21F 9/00; D21F 9/02; D21F 9/04; D21F 11/00; D21F 11/02; D21F 11/06
See application file for complete search history.

(56) References Cited

U.S. PATENT DOCUMENTS

| | | | | |
|---|---|---|---|---|
| 2015/0240417 | A1* | 8/2015 | Higuchi | D21B 1/06 162/261 |
| 2015/0247286 | A1 | 9/2015 | Nagai | |
| 2016/0230338 | A1 | 8/2016 | Nakamura et al. | |
| 2016/0332325 | A1 | 11/2016 | Murayama et al. | |
| 2019/0270220 | A1* | 9/2019 | Oguchi | C22C 21/00 |
| 2019/0309475 | A1* | 10/2019 | Inagaki | F24F 6/04 |
| 2021/0277602 | A1* | 9/2021 | Oguchi | D21F 9/00 |
| 2021/0292970 | A1* | 9/2021 | Oguchi | B27N 3/26 |
| 2021/0292971 | A1* | 9/2021 | Gomi | D21F 7/008 |

FOREIGN PATENT DOCUMENTS

| | | | |
|---|---|---|---|
| JP | 2014-084532 | A | 5/2014 |
| JP | 2015-066932 | A | 4/2015 |
| JP | 2015-161035 | A | 9/2015 |
| JP | 2015-227523 | A | 12/2015 |
| WO | 2015/128912 | A1 | 9/2015 |

* cited by examiner

SHEET MANUFACTURING APPARATUS

CROSS-REFERENCE TO RELATED APPLICATIONS

This application is a U.S. National stage application of International Patent Application No. PCT/JP2017/002331, filed on Jan. 24, 2017, which claims priority under 35 U.S.C. § 119(a) to Japanese Patent Application No. 2016-029094, filed in Japan on Feb. 18, 2016. The entire disclosure of Japanese Patent Application No. 2016-029094 is hereby incorporated herein by reference.

TECHNICAL FIELD

The present invention relates to a sheet manufacturing apparatus.

BACKGROUND ART

In the related art, in a sheet manufacturing apparatus, a so-called wet type is adopted in which a raw material containing fibers is charged into water, the material is mainly defibrated by a mechanical action and is made into a sheet. Such a wet type sheet manufacturing apparatus requires a large amount of water and the apparatus becomes large. Furthermore, it takes time and effort to maintain maintenance of a water treatment facility, and the energy of a drying step increases. Therefore, in order to reduce the size and save energy, a dry type sheet manufacturing —apparatus that does not utilize water as much as possible has been proposed.

For example, in Japanese Unexamined Patent Application Publication No. 2015-66932, in a dry type sheet manufacturing apparatus, it is described that a residue that has not passed through a first opening of a sorting portion is transported to a hopper (hopper into which a strip cut by a coarse crushing blade is introduced) via a transport portion as a return flow passage and returned to a defibrating portion again.

The residue that did not pass through the first opening of the sorting portion is heated and dried by defibrating treatment. Therefore, when the residue is transported to the hopper (shooter) as in the sheet manufacturing apparatus described in Japanese Unexamined Patent Application Publication No. 2015-66932, the shooter dried and a strip (coarse crushed pieces) cut by a coarse crushing blade adhered to the shooter due to electrostatic force in some cases. As a result, the amount of defibrated materials flowing through the sheet manufacturing apparatus was unstable, and the thickness of the sheet to be manufactured might vary.

SUMMARY

An object of some aspects of the present invention is to provide a sheet manufacturing apparatus capable of suppressing adhesion of coarse crushed pieces to a shooter.

The present invention has been made to solve at least a portion of the above-described problems, and can be realized as the following aspects or application examples.

According to an aspect of the present invention, there is provided a sheet manufacturing apparatus including a coarse crushing portion that crushes a raw material containing a fiber into coarse crushed pieces, a defibrating portion that defibrates the coarse crushed pieces into a defibrated material, a sieve portion that includes a plurality of openings, a sheet forming portion that presses and heats the defibrated material passing through the opening of the sieve portion to form a sheet, and a transport passage that transports the defibrated material, which has not passed through the opening of the sieve portion, between the coarse crushing portion and the defibrating portion.

In such a sheet manufacturing apparatus, it is possible to return the defibrated material dried and heated by the defibrating treatment to the pipe (pipe connecting the coarse crushing portion and the defibrating portion) on the downstream side of the coarse crushing portion without returning the defibrated material to the shooter of the coarse crushing portion. Therefore, in such a sheet manufacturing apparatus, it is possible to suppress the adhesion of the coarse crushed pieces cut by the coarse crushing blade of the coarse crushing portion to the shooter.

The sheet manufacturing apparatus according to the present invention may include a humidifying portion that supplies humidified gas to the coarse crushing portion.

In such a sheet manufacturing apparatus, the coarse crushed pieces cut by the coarse crushing portion can be prevented from drying out. As a result, in such a sheet manufacturing apparatus, it is possible to more reliably suppress the adhesion of the coarse crushed pieces to the shooter due to the electrostatic force.

The sheet manufacturing apparatus according to the present invention may include a humidifying portion that humidifies the defibrated material passing through the opening of the sieve portion, and a supply passage that supplies gas humidified by the humidifying portion between the coarse crushing portion and the defibrating portion.

In such a sheet manufacturing apparatus, the gas humidified by the humidifying portion can humidify the inside of the pipe (pipe connecting the coarse crushing portion and the defibrating portion). As a result, in such a sheet manufacturing apparatus, it is possible to suppress the coarse crushed pieces passing through the pipe and the defibrated material from drying and adhering to the inner wall of the pipe due to the electrostatic force. Furthermore, in such a sheet manufacturing apparatus, the humidified gas can be recycled, and cost reduction can be achieved.

The sheet manufacturing apparatus according to the present invention may include an accumulation portion that accumulates the defibrated material passing through the opening of the sieve portion, a humidifying portion that humidifies an accumulated material accumulated by the accumulation portion, and a supply passage that supplies gas humidified by the humidifying portion between the coarse crushing portion and the defibrating portion.

In such a sheet manufacturing apparatus, the gas humidified by the humidifying portion can humidify the inside of the pipe (pipe connecting the coarse crushing portion and the defibrating portion). As a result, in such a sheet manufacturing apparatus, it is possible to suppress the coarse crushed pieces passing through the pipe and the defibrated material from drying and adhering to the inner wall of the pipe due to the electrostatic force.

Furthermore, in such a sheet manufacturing apparatus, the humidified gas can be recycled, and cost reduction can be achieved.

According to another aspect of the present invention, there is provided a sheet manufacturing apparatus including a coarse crushing portion that crushes a raw material containing a fiber into coarse crushed pieces, a defibrating portion that defibrates the coarse crushed pieces into a defibrated material, a sorting portion that sorts the defibrated material into a first sorted material and a second sorted material, an accumulation portion that includes a sieve portion and a covering portion covering at least a portion of the sieve portion, and accumulates the first sorted material sorted by the sorting portion, a sheet forming portion that presses and heats an accumulated material accumulated by the accumulation portion to form a sheet, a first transport passage that transports the second sorted material sorted by the sorting portion between the coarse crushing portion and the defibrating portion, a first humidifying portion that humidifies an inside of the covering portion of the accumulation portion, and a supply passage that supplies gas humidified by the first humidifying portion between the coarse crushing portion and the defibrating portion.

In such a sheet manufacturing apparatus, the gas humidified by the first humidifying portion can humidify the inside of the pipe (pipe connecting the coarse crushing portion and the defibrating portion). As a result, in such a sheet manufacturing apparatus, it is possible to suppress the coarse crushed pieces passing through the pipe and the defibrated material from drying and adhering to the inner wall of the pipe due to the electrostatic force. Furthermore, in such a sheet manufacturing apparatus, the humidified gas can be recycled, and cost reduction can be achieved.

The sheet manufacturing apparatus according to the present invention may include a second humidifying portion that humidifies the first sorted material sorted by the sorting portion, and a third humidifying portion that humidifies the accumulated material accumulated by the accumulation portion, in which the supply passage is a supply passage which supplies the gas humidified by the first humidifying portion, gas humidified by the second humidifying portion, and gas humidified by the third humidifying portion between the coarse crushing portion and the defibrating portion.

In such a sheet manufacturing apparatus, the gas humidified by the first humidifying portion, the second humidifying portion, and the third humidifying portion can humidify the inside of the pipe (pipe connecting the coarse crushing portion and the defibrating portion). As a result, in such a sheet manufacturing apparatus, it is possible to more reliably suppress the coarse crushed pieces passing through the pipe and the defibrated material from drying and adhering to the inner wall of the pipe due to the electrostatic force.

The sheet manufacturing apparatus according to the present invention may include a second transport passage that transports the first sorted material sorted by the sorting portion to the accumulation portion, and a fourth humidifying portion that introduces humidified gas into the second transport passage.

In such a sheet manufacturing apparatus, it is possible to humidify the second transport passage by the gas humidified by the fourth humidifying portion. As a result, in such a sheet manufacturing apparatus, it is possible to suppress the adhere of the defibrated material by the electrostatic force to the member (for example, rotating object) located in the second transport passage.

DESCRIPTION OF EMBODIMENTS

Hereinafter, preferred embodiments of the present invention will be described in detail below with reference to the drawings. The embodiments described below do not unduly limit the contents of the present invention described in the aspects. In addition, not all of the configurations described below are necessarily essential components of the present invention.

1. First Embodiment

1.1. Sheet Manufacturing Apparatus

1.1.1. Configuration

Figure 1:
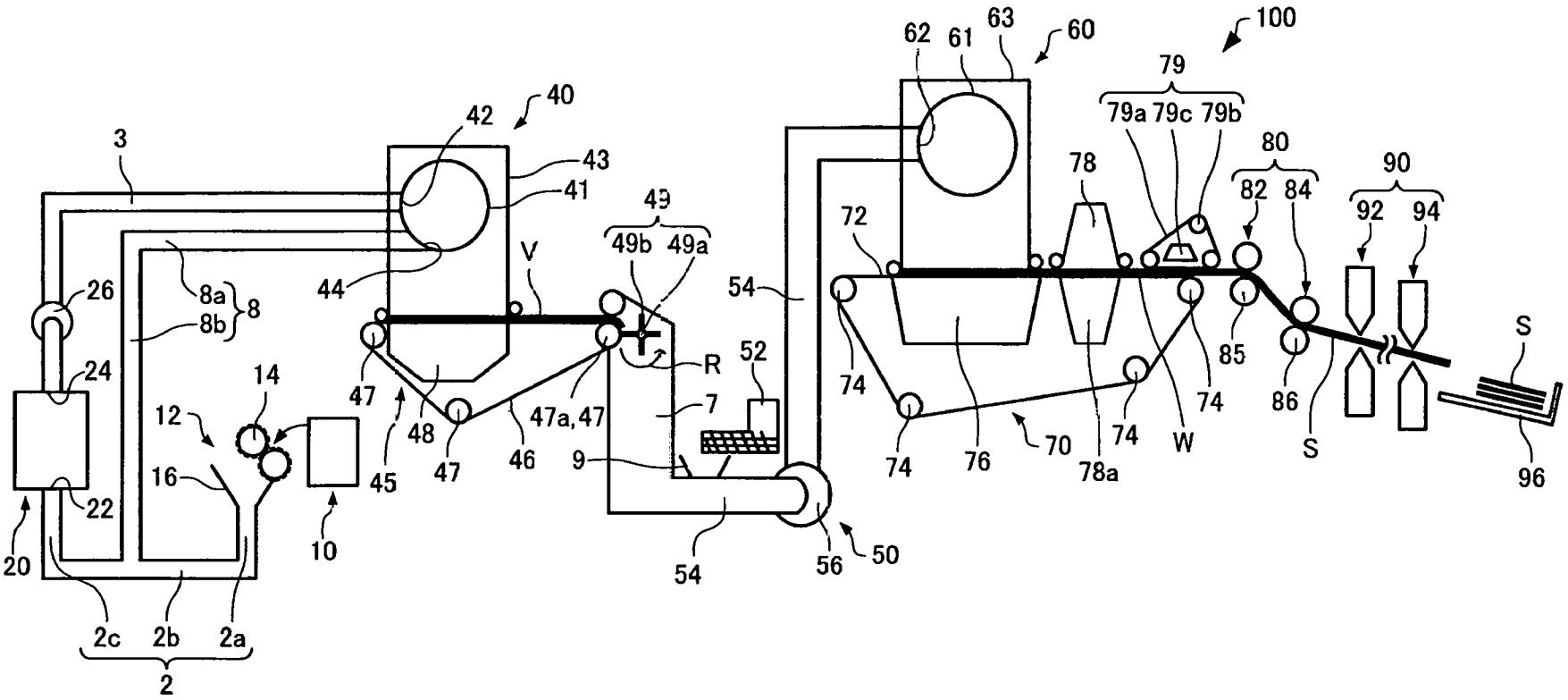
FIG. 1 is a view schematically illustrating a sheet manufacturing apparatus according to a first embodiment.

First, a sheet manufacturing apparatus according to the first embodiment will be described with reference to the drawings. FIG. 1 is a view schematically illustrating a sheet manufacturing apparatus 100 according to the first embodiment.

As illustrated in FIG. 1, the sheet manufacturing apparatus 100 is provided with a supply portion 10, a coarse crushing portion 12, a defibrating portion 20, a sorting portion 40, a first web forming portion 45, a rotating object 49, a mixing portion 50, an accumulation portion 60, a second web forming portion 70, a sheet forming portion 80, and a cutting portion 90.

The supply portion 10 supplies the raw material to the coarse crushing portion 12. The supply portion 10 is, for example, an automatic input portion for continuously inputting the raw material into the coarse crushing portion 12. The raw material supplied by the supply portion 10 contains fibers such as waste paper and pulp sheet, for example.

The coarse crushing portion 12 cuts (coarsely crushes) the raw material supplied by the supply portion 10 in the air such as atmosphere (in air) to form coarse crushed pieces. The shape and size of the coarse crushed piece is, for example, a strip of several cm square. The coarse crushing portion 12 has, for example, a coarse crushing blade 14 and a shooter (hopper) 16. The coarse crushing portion 12 is able to cut the input raw material by the coarse crushing blade 14. For example, a shredder is used as the coarse crushing portion 12. The raw material cut by the coarse crushing blade 14 is transferred (transported) to the defibrating portion 20 via a pipe 2 after being received by the shooter 16.

The defibrating portion 20 defibrates the raw material (coarse crushed piece) cut by the coarse crushing portion 12 into a defibrated material. Here, "to defibrate" means to unravel the raw material (material to be defibrated) formed by binding a plurality of fibers to each fiber one by one. The defibrating portion 20 also has a function of separating substances such as resin material, ink, toner, bleed inhibitor and the like attached to the raw material from the fiber.

Material which passed through the defibrating portion 20 is referred to as "defibrated material". The "defibrated material" may contain resin (resin for bonding a plurality of fibers) material separated from fibers when unraveling fibers, coloring agents such as ink and toner, or additives such as bleed inhibitor and paper strength enhancer in addition to unraveling defibrated fibers. The shape of unraveled defibrated material is a string or ribbon shape. The unraveled defibrated material may exist in a state not intertwined with other unraveled fiber (independent state), or may exist in a state of being intertwined with other unraveled defibrated material to form a lump (state of forming so-called "lump").

The defibrating portion 20 performs defibration with a dry method. Herein, performing treatment such as defibration in the air such as atmosphere (in air) rather than in a liquid is referred to as the dry method. As the defibrating portion 20, an impeller mill is used in this embodiment. The defibrating portion 20 has a function of generating the air flow that sucks the raw material and discharges the defibrated material. As a result, the defibrating portion 20 can suck the raw material together with the air flow from an introduction port 22 by the air flow generated by itself, and can perform defibration treatment to transport the defibrated material to a discharge port 24. The defibrated material that has passed through the defibrating portion 20 is transferred to the sorting portion 40 via a pipe 3. As the air flow for transporting the defibrated material from the defibrating portion 20 to the sorting portion 40, the air flow generated by the defibrating portion 20 may be used, or a blower 26 as an air flow generation device may be provided as illustrated in FIG. 1, and the air flow thereof may be used.

In the sorting portion 40, the defibrated material defibrated by the defibrating portion 20 is introduced from an introduction port 42 and sorted according to the length of the fiber. The sorting portion 40 has a drum portion 41 (sieve portion) and a housing portion (covering portion) 43 for housing the drum portion 41. As the drum portion 41, for example, a sieve is used. The drum portion 41 has a mesh (filter, screen) and can sort a fiber or a material smaller than a size of mesh sieve (opening) (those passing through the mesh, first sorted material), and a fiber, un-defibrated piece, or a lump larger than the size of mesh sieve (those not passing through the mesh, second sorted material). That is, the sorting portion 40 can sort the defibrated material into a first sorted material and a second sorted material. For example, the first sorted material is transferred to the mixing portion 50 via a pipe 7. The second sorted material is returned from a discharge port 44 to the defibrating portion 20 via a pipe 8. Specifically, the drum portion 41 is a sieve of a cylinder rotationally driven by a motor. As the mesh of the drum portion 41, for example, a wire mesh, an expanded metal obtained by stretching a metal plate with a notch, and a punching metal having a hole formed in a metal plate by a pressing machine or the like are used.

The first web forming portion 45 transports the first sorted material that has passed through the sorting portion 40 to the mixing portion 50. The first web forming portion 45 includes a mesh belt 46, a stretching roller 47, and a suction portion (suction mechanism) 48.

The suction portion 48 can suck the first sorted material dispersed in the air through an opening (mesh opening) of the sorting portion 40 onto the mesh belt 46. The first sorted material is accumulated on the moving mesh belt 46 to form a web V. The basic configuration of the mesh belt 46, the stretching roller 47, and the suction portion 48 is the same as that of a mesh belt 72, a stretching roller 74, and a suction mechanism 76 of a second web forming portion 70 described later.

By passing through the sorting portion 40 and the first web forming portion 45, a web V containing a large amount of air and in a soft and swelling state is formed. The web V accumulated on the mesh belt 46 is introduced into the pipe 7 and transported to the mixing portion 50.

The rotating object 49 can cut (divide) the web V before the web V is transported to the mixing portion 50. In the illustrated example, the rotating object 49 has a base portion 49*a* and a projection portion 49*b* projecting from the base portion 49*a*. The projection portion 49*b* has, for example, a plate shape. In the illustrated example, four projection portions 49*b* are provided, and four projection portions 49*b* are provided at equal intervals. By rotation of the base portion 49*a* in a direction R, the projection portion 49*b* can rotate about the base portion 49*a*. By cutting the web V with the rotating object 49, it is possible to reduce fluctuation in the amount of defibrated material per unit time supplied to the accumulation portion 60, for example.

The rotating object 49 is provided in the vicinity of the first web forming portion 45. In the illustrated example, the rotating object 49 is provided in the vicinity of a stretching roller 47*a* (next to stretching roller 47*a*) located on the downstream side in the passage of the web V. The rotating object 49 is provided at a position where the projection portion 49*b* can be in contact with the web V and is not in contact with the mesh belt 46 on which the web V is accumulated. As a result, it is possible to prevent the mesh belt 46 from being worn (damaged) by the projection portion 49*b*. The shortest distance between the projection portion 49*b* and the mesh belt 46 is, for example, 0.05 mm or more and 0.5 mm or less. If the shortest distance between the projection portion 49*b* and the mesh belt 46 is within the above range, the rotating object 49 can cut the web V without damaging the mesh belt 46.

The mixing portion 50 mixes the first sorted material (first sorted material transported by first web forming portion 45) that has passed through the sorting portion 40 and the additive including a resin. The mixing portion 50 has an additive supply portion 52 for supplying the additive, a pipe 54 for transporting the first sorted material and the additive, and a blower 56. In the illustrated example, the additive is supplied to the pipe 54 from the additive supply portion 52 via a shooter 9. The pipe 54 is continuous with the pipe 7.

In the mixing portion 50, air flow is generated by the blower 56, and the first sorted material and additives can be transported while being mixed in the pipe 54. The mechanism for mixing the first sorted material and the additive is not particularly limited, and may be a mechanism that stirs with a blade rotating at high speed, or a mechanism that uses rotation of a container like a V type mixer.

As the additive supply portion 52, a screw feeder as illustrated in FIG. 1, a disk feeder not illustrated or the like is used. The additive supplied from the additive supply portion 52 contains a resin for binding a plurality of fibers. When the resin is supplied, the plurality of fibers are not bound. When passing through the sheet forming portion 80, the resin melts and binds the plurality of fibers.

The resin supplied from the additive supply portion 52 is a thermoplastic resin or a thermosetting resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, polyether ether ketone, and the like. These resins may be used singly or as a mixture thereof. The additive supplied from the additive supply portion 52 may be in a fibrous form or powder form.

The additives supplied from the additive supply portion 52 may contain a coloring agent for coloring the fibers, an aggregation inhibitor for suppressing aggregation of the fibers or aggregation of the fibers, and a flame retardant for causing fibers less flammable, in addition to the resin binding the fibers, depending on the type of the sheet to be manufactured. The mixture (mixture of first sorted material and additive) that has passed through the mixing portion 50 is transferred to the accumulation portion 60 via the pipe 54.

The accumulation portion 60 introduces the mixture that has passed through the mixing portion 50 from an introduction port 62, unravels the intertwined defibrated material (fibers), and descends while dispersing in the air. Furthermore, in a case where the resin of the additive supplied from the additive supply portion 52 has a fibrous form, the accumulation portion 60 unravels the intertwined resin. As a result, the accumulation portion 60 can accumulate the mixture with good uniformity in the second web forming portion 70.

The accumulation portion 60 has a drum portion (sieve portion) 61 and a housing portion (covering portion) 63 for accommodating the drum portion 61. As the drum portion 61, a rotating cylindrical sieve is used. The drum portion 61 has a mesh and causes fibers or particles (fibers or material passing through mesh) smaller than the size of mesh sieve (opening) and contained in the mixture passed through the mixing portion 50 to descend. The configuration of the drum portion 61 is, for example, the same as that of the drum portion 41.

The "sieve" of the drum portion 61 may not have the function of sorting out a specific object. That is, the "sieve" used as the drum portion 61 means that the sieve has a mesh, and the drum portion 61 may descend all of the mixture introduced to the drum portion 61.

The second web forming portion 70 accumulates a passing material that has passed through the accumulation portion 60 to form a web W. The second web forming portion 70 has, for example, a mesh belt 72, a stretching roller 74, and a suction mechanism 76.

While moving, the mesh belt 72 accumulates the passing material passing through the opening (opening of mesh) of the accumulation portion 60. The mesh belt 72 is stretched by the stretching roller 74, and is configured so as to allow air to pass therethrough with difficulty in passing the passing material. The mesh belt 72 moves as the stretching roller 74 rotates on its own axis. While the mesh belt 72 continuously moves, the passing material passing through the accumulation portion 60 continuously accumulates, so that the web W is formed on the mesh belt 72. The mesh belt 72 is formed of, for example, metal, resin, cloth, or nonwoven fabric.

The suction mechanism 76 is provided below the mesh belt 72 (on a side opposite to accumulation portion 60 side). The suction mechanism 76 can generate an air flow directed downward (air flow directed from the accumulation portion 60 to the mesh belt 72). By the suction mechanism 76, the mixture dispersed in the air by the accumulation portion 60 can be sucked onto the mesh belt 72. As a result, the discharge rate from the accumulation portion 60 can be increased. Furthermore, the suction mechanism 76 can form a down flow in the falling passage of the mixture, and it is possible to prevent from being intertwined with the defibrated material and the additive during the falling.

As described above, by passing through the accumulation portion 60 and the second web forming portion 70 (web forming step), a web W containing a large amount of air and in a soft and swelling state is formed. The web W accumulated on the mesh belt 72 is transported to the sheet forming portion 80.

In the illustrated example, a humidity conditioning portion (humidifying portion for humidifying web W) 78 for conditioning the web W is provided. A humidifying portion 78 can adjust the amount ratio between the web W and water by adding water or vapor to the web W. In the illustrated example, the humidifying portion 78 is provided above the mesh belt 72 (on accumulation portion 60 side). A suction mechanism 78*a* is provided below the mesh belt 72 (side opposite to humidifying portion 78 side). The suction mechanism 78*a* can generate an air flow directed downward (directed to mesh belt 72 from humidifying portion 78). As a result, it possible to humidify the web W uniformly in the thickness direction.

In addition, in the illustrated example, a transport portion 79 for transporting the web W on the mesh belt 72 to the sheet forming portion 80 is provided. The transport portion 79 has, for example, a mesh belt 79*a*, a stretching roller 79*b*, and a suction mechanism 79*c*. The suction mechanism 79*c* generates an air flow to suck the web W and causes the mesh belt 79*a* to adsorb the web W. The mesh belt 79*a* moves due to the rotation of the stretching roller 79*b*, and transports the web W to the sheet forming portion 80. The movement speed of the mesh belt 72 and the movement speed of the mesh belt 79*a* are the same as each other, for example.

The sheet forming portion 80 presses and heats the web W accumulated on the mesh belt 72 (accumulated material accumulated by accumulation portion 60) to form a sheet S. In the sheet forming portion 80, a plurality of fibers in the mixture can be bound to each other via the additive (resin) by applying heat to the mixture of the defibrated material and additive mixed in the web W.

The sheet forming portion 80 is provided with a pressing portion 82 that presses the web W and a heating portion 84 that heats the web W pressed by the pressing portion 82. The pressing portion 82 is configured to include a pair of calendar rollers 85, and applies pressure to the web W. As the web W is pressed, the thickness decreases and the density of the web W increases. As the heating portion 84, for example, a heating roller, a hot press molding machine, a hot plate, a hot air blower, an infrared heater, and a flash fixing device are used. In the illustrated example, the heating portion 84 is provided with a pair of heating rollers 86. By configuring the heating portion 84 as the pair of heating rollers 86, the sheet S can be formed while continuously transporting the web W, as compared with a case where the heating portion 84 is configured as a plate-like pressing device (flat plate pressing device). Here, the calendar rollers 85 (pressing portion 82) can apply a pressure higher than the pressure applied to the web W by the heating rollers 86 (heating portion 84) to the web W. The number of the calendar rollers 85 and the pair of heating rollers 86 is not particularly limited.

The cutting portion 90 cuts the sheet S formed by the sheet forming portion 80. In the illustrated example, the cutting portion 90 has a first cutting portion 92 for cutting the sheet S in a direction intersecting with the transport direction of the sheet S and a second cutting portion 94 for cutting the sheet S in a direction parallel to the transport direction. For example, the second cutting portion 94 cuts the sheet S that has passed through the first cutting portion 92.

As described above, a single sheet S of a predetermined size is formed. The cut single sheet S is discharged to a discharge portion 96.

In the sheet manufacturing apparatus 100, the defibrated material that has passed through the defibrating portion 20 may be transferred to a classifying portion (not illustrated) via the pipe 3. A classified material in the classifying portion may be transported to the sorting portion 40. The classifying portion classifies the defibrated material that has passed through the defibrating portion 20. Specifically, the classifying portion separates and removes relatively small material or material with low density (such as resin material, coloring agent, and additive) among the defibrated materials. As a result, it is possible to increase the proportion occupied by fibers which are relatively large material or material with high density among the defibrated materials. As the classifying portion, for example, cyclone, elbow jet, eddy classifier are used.

1.1.2. Pipe

The sheet manufacturing apparatus 100 has the pipes 2 and 8 as described above. Hereinafter, the pipes 2 and 8 will be described in detail.

As illustrated in FIG. 1, the pipe 2 connects the coarse crushing portion 12 with the defibrating portion 20. In the illustrated example, the pipe 2 connects the shooter 16 of the coarse crushing portion 12 with the defibrating portion 20. For example, the inner diameter of the pipe 2 is 50 mm or more and 60 mm or less. The pipe 2 forms a transport passage for transporting the raw material (coarse crushed piece) cut by the coarse crushing blade 14 to the defibrating portion 20.

The shooter 16 has, for example, a tapered shape in which the width gradually decreases in a direction where the coarse crushed piece flows (in a traveling direction). Therefore, the shooter 16 can receive many coarse crushed pieces.

The pipe 2 has, for example, a first portion 2*a*, a second portion 2*b*, and a third portion 2*c*. The first portion 2*a* and the third portion 2*c*, for example, extend in a vertical direction. The second portion 2*b*, for example, extends in a horizontal direction. The first portion 2*a* connects the coarse crushing portion 12 with the second portion 2*b*. The second portion 2*b* connects the first portion 2*a* with the third portion 2*c*. The third portion 2*c* connects the second portion 2*b* and the defibrating portion 20.

The pipe 8 connects the sorting portion 40 with the pipe 2. In the illustrated example, the pipe 8 connects the sieve portion 41 (sieve portion having a plurality of openings) of the sorting portion 40 with the second portion 2*b* of the pipe 2. For example, the inner diameter of the pipe 8 is 90 mm or more and 120 mm or less. The pipe 8 forms the transport passage (first transport passage) for transporting the defibrated material (second sorted material) which did not pass through the opening of the sieve portion 41 between the coarse crushing portion 12 and the defibrating portion 20 (into the pipe 2). The second sorted material is dried and heated as it passes through the defibrating portion 20 once (since defibrating treatment is performed). The second sorted material reaches the defibrating portion 20 again through the pipe 8 and the pipe 2 (portions 2*b* and 2*c*). The sheet forming portion 80 pressurizes and heats the defibrated material (first sorted material) that has passed through the opening of the sieve portion 41 to form a sheet S.

The pipe 8 has, for example, a fourth portion 8*a* and a fifth portion 8*b*. The fourth portion 8*a* extends in the horizontal direction, for example. The fifth portion 8*b* extends in the vertical direction, for example. The fourth portion 8*a* connects the sorting portion 40 with the fifth portion 8*b*. The fifth portion 8*b* connects the fourth portion 8*a* with the second portion 2*b* of the pipe 2. The fifth portion 8*b* can transport the second sorted material into the pipe 2, for example, by gravity. In the illustrated example, the second portion 2*b* of the pipe 2 is orthogonal to the fifth portion 8*b* of the pipe 8.

1.1.3. Configuration in a Vicinity of Rotating Object

Figure 2:
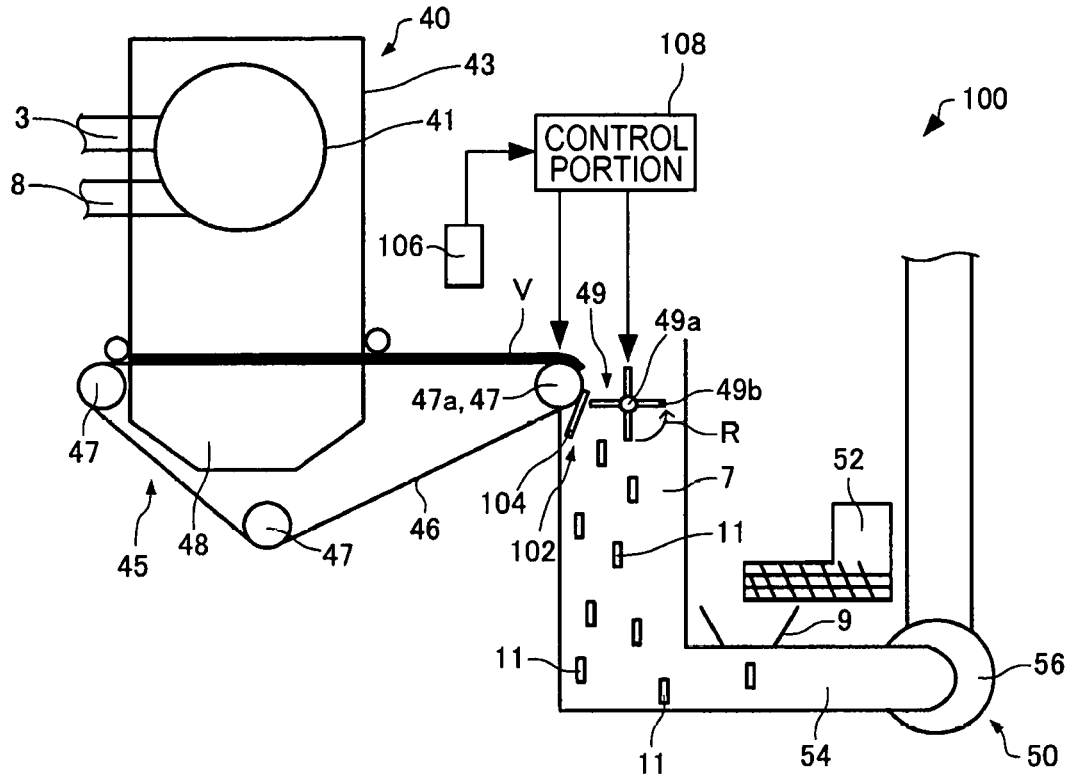
FIG. 2 is a view schematically illustrating the sheet manufacturing apparatus according to the first embodiment.

FIG. 2 is an enlarged view of the vicinity of the rotating object 49 in FIG. 1. As illustrated in FIG. 2, the sheet manufacturing apparatus 100 has a separation portion 102, a detection portion 106, and a control portion 108. For the sake of convenience, illustration of the separation portion 102, the detection portion 106, the control portion 108, and a subdivided object 11 (web V cut by rotating object 49) is omitted in FIG. 1.

The separation portion 102 is a member for separating the web V accumulated on the mesh belt 46 from the mesh belt 46. The separation portion 102 has a fixing plate 104. In the illustrated example, the separation portion 102 is constituted by the fixing plate 104. The fixing plate 104 is provided in the vicinity of the rotating object 49. In the illustrated example, the web forming portion 45 has three stretching rollers 47 on which the mesh belt 46 is stretched, and the fixing plate 104 faces the stretching roller 47*a* located on the side closest to the rotating object 49 among the three stretching rollers via the mesh belt 46. The fixing plate 104 is in contact with the mesh belt 46 in a state where the mesh belt 46 is movable. The fixing plate 104 does not move with the movement of the mesh belt 46 and is fixed.

The detection portion 106 detects the thickness of the web V accumulated on the mesh belt 46. For example, the detection portion 106 receives reflected light on a front surface of the web V and the reflected light on a rear surface, and an optical sensor that detects the thickness of the web V based on the time difference between the reflected light on the front surface and the reflected light on the rear surface. The detection portion 106, for example, faces the mesh belt 46.

The control portion 108 may control a movement speed of the mesh belt 46 by outputting a first signal to a first drive portion (not illustrated) that drives the stretching roller 47 based on the thickness of the web V detected by the detection portion 106. For example, in a case where the thickness of the web V detected by the detection portion 106 is greater than a predetermined value, the control portion 108 controls so as to decrease the movement speed of the mesh belt 46. As a result, the amount of the defibrated material per unit time supplied to the mixing portion 50 can be prevented from increasing. In addition, for example, in a case where the thickness of the web V detected by the detection portion 106 is smaller than the predetermined value, the control portion 108 controls so as to increase the movement speed of the mesh belt 46. As a result, the amount of the defibrated material per unit time supplied to the mixing portion 50 can be prevented from decreasing. That is, the control portion 108 controls the movement speed of the mesh belt 46 so that the variation of the amount (mass) of the defibrated material per unit time supplied to the mixing portion 50 is small.

The control portion 108 may control a rotation speed of the rotating object 49 by outputting a second signal to a second drive portion (not illustrated) for driving the rotating object 49 according to the movement speed of the mesh belt 46. For example, data on the movement speed of the mesh belt 46 and the rotation speed of the rotating object 49 are stored in advance in a storage portion (not illustrated), and the control portion 108 may control the rotation speed of the rotating object 49 based on the data and the first signal. For example, in a case where the movement speed of the mesh belt 46 is controlled so as to be decreased by the first signal, the control portion 108 controls so as to decrease the rotation speed of the rotating object 49. As a result, the volume of the subdivided object 11 supplied to the mixing portion 50 can be prevented from decreasing. In addition, for example, in a case where the movement speed of the mesh belt 46 is controlled so as to be increased by the first signal, the control portion 108 controls so as to increase the rotation speed of the rotating object 49. As a result, the volume of the subdivided object 11 supplied to the mixing portion 50 can be prevented from increasing. That is, the control portion 108 controls the rotation speed of the rotating object 49 so that the variation of the volume of the subdivided object 11 supplied to the mixing portion 50 is small.

The control portion 108 may control the rotation speed of the rotating object 49 by outputting a third signal to a second drive portion (not illustrated) that drives the rotating object 49 based on the thickness of the web V detected by the detection portion 106. For example, in a case where the thickness of the web V detected by the detection portion 106 is greater than the predetermined value, the control portion 108 controls so as to increase the rotation speed of the rotating object 49. As a result, the volume of the subdivided object 11 supplied to the mixing portion 50 can be prevented from increasing. In addition, for example, in a case where the thickness of the web V detected by the detection portion 106 is smaller than the predetermined value, the control portion 108 controls so as to decrease the rotation speed of the rotating object 49. As a result, the volume of the subdivided object 11 supplied to the mixing portion 50 can be prevented from decreasing.

Figure 3:
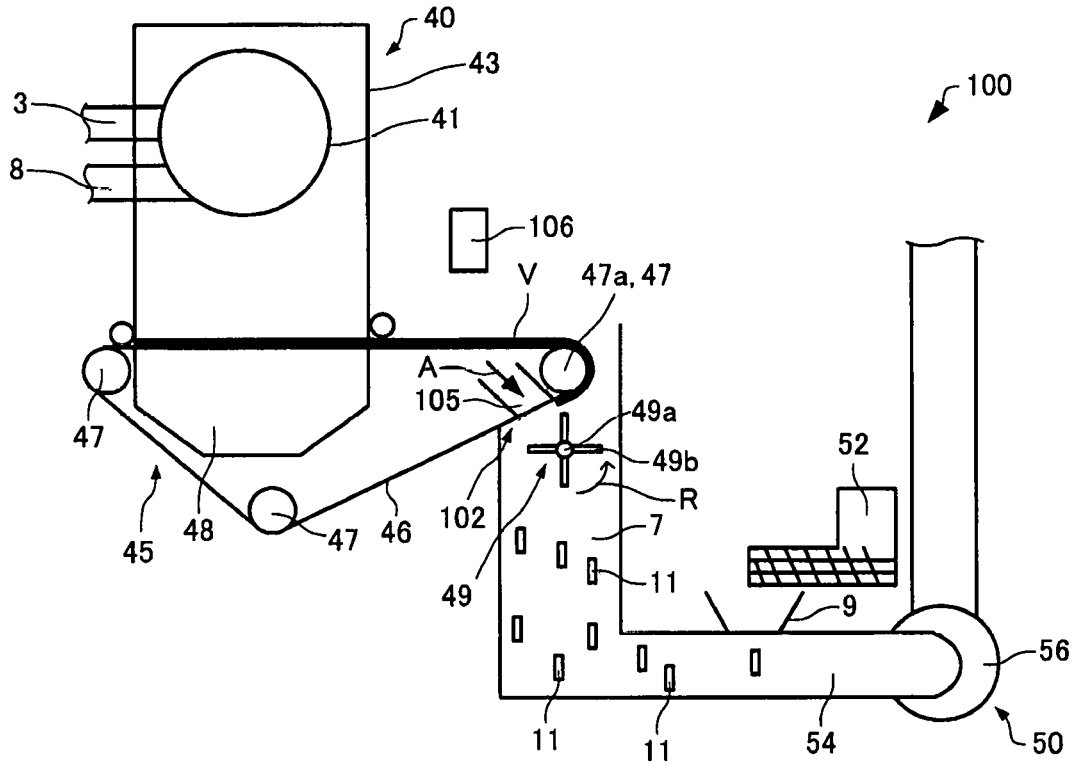
FIG. 3 is a view schematically illustrating the sheet manufacturing apparatus according to the first embodiment.

In the sheet manufacturing apparatus 100, as illustrated in FIG. 3, the separation portion 102 may have an air flow generation portion 105. In the illustrated example, the separation portion 102 is constituted by the air flow generation portion 105. The air flow generation portion 105 generates an air flow A in a direction where the web V separates from the mesh belt 46. The air flow generation portion 105 generates the air flow A in the vicinity of the rotating object 49. Here, the fact that "air flow generation portion 105 generates the air flow A in the vicinity of the rotating object 49" means that the air flow A generated in the air flow generation portion 105 reaches the rotating object 49. For the sake of convenience, illustration of the control portion 108 is omitted in FIG. 3.

The sheet manufacturing apparatus 100 has, for example, the following features.

The sheet manufacturing apparatus 100 has the pipe 8 forming a transport passage for transporting the defibrated material (second sorted material) that has not passed through the opening of the sieve portion 41 between the coarse crushing portion 12 and the defibrating portion 20. Therefore, in the sheet manufacturing apparatus 100, it is possible to return the second sorted material dried and heated by the defibration treatment into the pipe 2 on the downstream side of the coarse crushing portion 12 without returning the second sorted material to the shooter 16 of the coarse crushing portion 12. Therefore, in the sheet manufacturing apparatus 100, it is possible to suppress the adhesion of the coarse crushed piece to the shooter 16. Therefore, in the sheet manufacturing apparatus 100, it is possible to prevent the amount of defibrated material flowing through the sheet manufacturing apparatus 100 from being unstable, and to suppress variations in the thickness of the sheet S.

For example, when the second sorted material is returned to the shooter 16, the shooter 16 is warmed by the second sorted material, drying of the defibrated material progresses, and the coarse crushed piece (charged coarse crushed piece) may adhere to the shooter 16 due to the electrostatic force. Since the shooter 16 has a tapered shape, for example, there is a portion where the wind velocity of the air flow by the blower 26 becomes small in the shooter 16, and when the dried second sorted material is charged therein, the coarse crushed piece adheres due to the electrostatic force. In the sheet manufacturing apparatus 100, it is possible to avoid the above problem.

For example, in a case of returning the second sorted material to the shooter 16, the temperature of the shooter 16 was 50° C. and the relative humidity in the vicinity of the shooter 16 was 12%, whereas in the sheet manufacturing apparatus 100 for returning the second sorted material into the pipe 2, it was possible to set the temperature of the shooter 16 at 30° C. and the relative humidity in the vicinity of the shooter 16 to 40%. For example, in a case where the relative humidity in the vicinity of the shooter 16 is 30% or less, adhesion of the coarse crushed piece due to electrostatic force occurs.

Although not illustrated, the sheet manufacturing apparatus 100 may have a pipe for returning the defibrated material that did not passed through the opening of the sieve portion 61 of the accumulation portion 60 into the pipe 2. As a result, the sheet manufacturing apparatus 100 can prevent the coarse crushed piece from drying and adhering to the shooter 16 due to the defibrated material that did not pass through the opening of the sieve portion 61.

In addition, although not illustrated, in a case where the passage of the pipe 8 is long, or in a case where a joint portion between the pipe 2 and the pipe 8 is in the horizontal direction with respect to the discharge port 44 or above the discharge port 44, it is preferable to provide a blower in the pipe 2 and the pipe 8 for transporting the second sorted material into the pipe 2.

1.2. Modified Example of Sheet Manufacturing Apparatus

Figure 4:
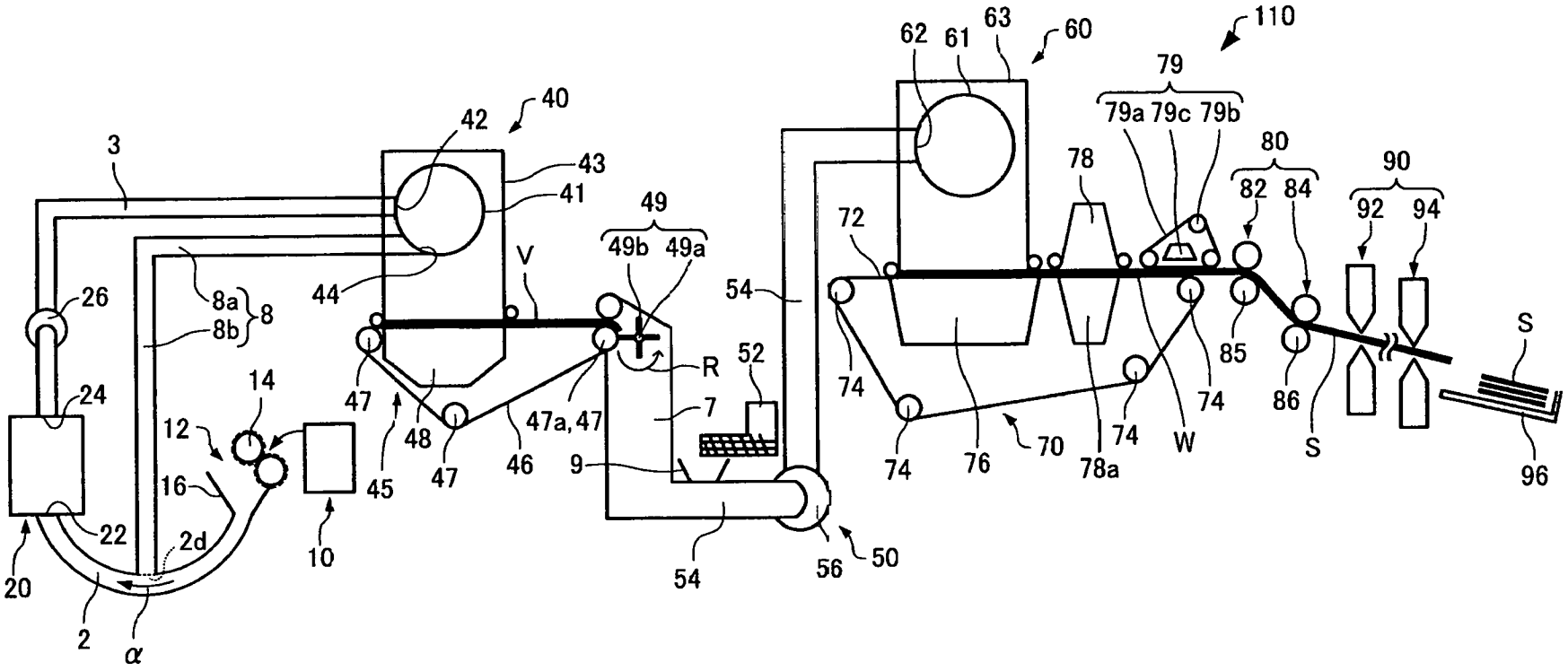
FIG. 4 is a view schematically illustrating a sheet manufacturing apparatus according to a modified example of the first embodiment.

Next, a sheet manufacturing apparatus according to a modified example of the first embodiment will be described with reference to the drawings. FIG. 4 is a view schematically illustrating a sheet manufacturing apparatus 110 according to the modified example of the first embodiment. Hereinafter, in the sheet manufacturing apparatus 110 according to the modified example of the first embodiment, members having the same functions as those of the above-described sheet manufacturing apparatus 100 are denoted by the same reference numerals, and a detailed description thereof will be omitted.

In the above-described sheet manufacturing apparatus 100, as illustrated in FIG. 1, the pipe 2 is configured to include linearly extending portions 2*a*, 2*b*, and 2*c*. On the other hand, in the sheet manufacturing apparatus 110, as illustrated in FIG. 4, the pipe 2 has a curved shape. An introduction port 2*d* is provided inside the curved pipe 2.

The introduction port 2*d* is an opening for introducing the second sorted material transported by the pipe 8 into the pipe 2.

Since the pipe 2 is curved, an air flow (air flow generated by the blower 26, for example) a generated in the pipe 2 causes a velocity difference (wind velocity) due to centrifugal force. That is, in the air flow α passing through the pipe 2, the velocity inside the pipe 2 (side with larger curvature) is smaller than the velocity outside the pipe 2 (side with smaller curvature). As described above, the air flow α has the velocity difference in a direction orthogonal to the direction of the air flow α. The introduction port 2*d* is provided on the side where the velocity of the air flow α is low (inside pipe 2). The difference between the velocity of the air flow α inside the pipe 2 and the velocity of the air flow α outside the pipe 2 is, for example, 1 m/s or more and 10 m/s or less, and preferably approximately 5 m/s.

In the sheet manufacturing apparatus 110, the air flow α has the velocity difference in a direction orthogonal to the direction of the air flow α in the pipe 2, and the introduction port 2*d* is provided on the side where the velocity of air flow α is low. Therefore, in the sheet manufacturing apparatus 110, a force acts on the side where the velocity of the air flow α is high (outside of the pipe 2) from the side where the velocity of the air flow α is low (inside of the pipe 2), and it is possible to suppress the blowback of the air flow α at the introduction port 2*d*. Therefore, in the sheet manufacturing apparatus 110, it is possible to suppress retention of the coarse crushed piece due to the disturbance of the air flow α by the blowback of the air flow α. Furthermore, in the sheet manufacturing apparatus 110, for example, it is possible to suppress the retention of the coarse crushed piece due to the lack of the air volume on the downstream side by the blowback of the air flow α. As a result, in the sheet manufacturing apparatus 110, it is possible to stably transport the coarse crushed piece.

2. Second Embodiment

2.1. Sheet Manufacturing Apparatus

Figure 5:
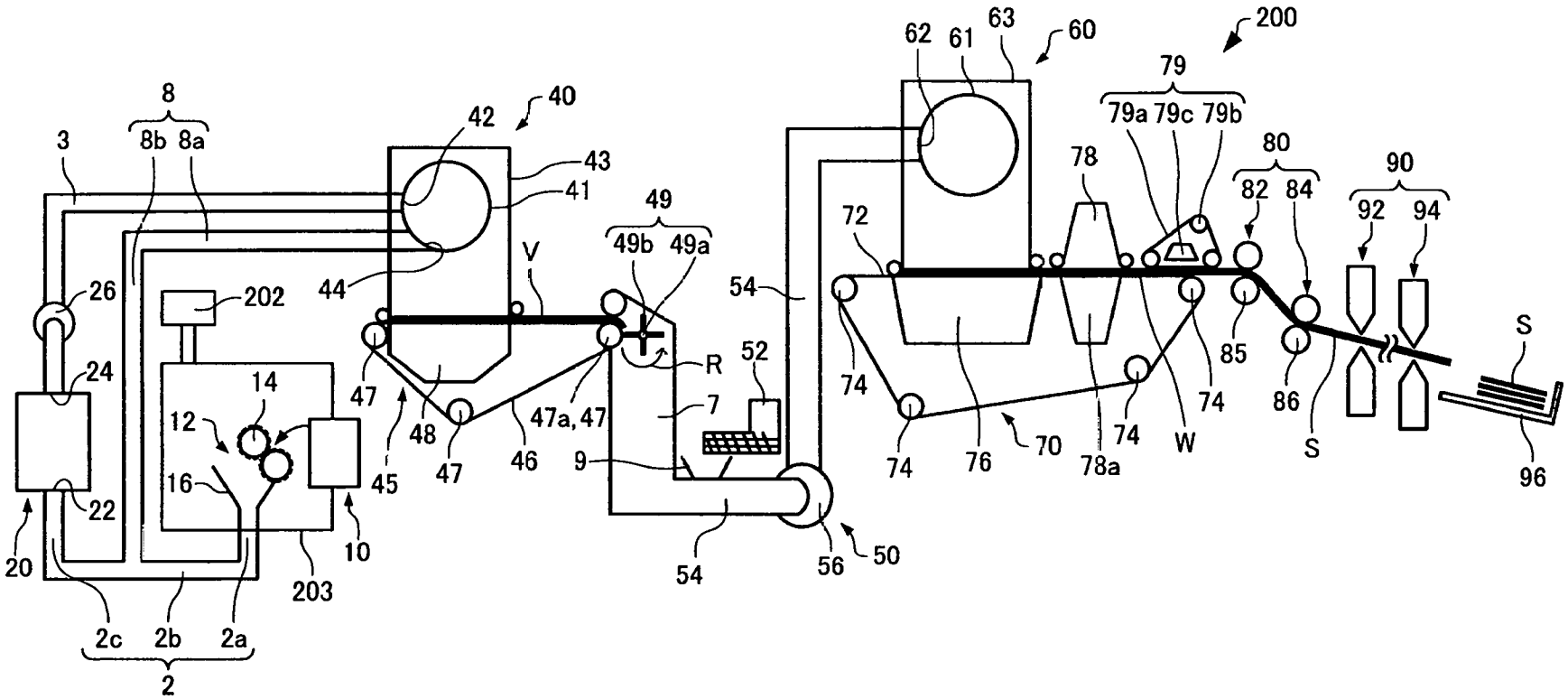
FIG. 5 is a view schematically illustrating a sheet manufacturing apparatus according to a second embodiment.

Next, a sheet manufacturing apparatus according to a second embodiment will be described with reference to the drawings. FIG. 5 is a view schematically illustrating a sheet manufacturing apparatus 200 according to the second embodiment. Hereinafter, in the sheet manufacturing apparatus 200 according to the second embodiment, members having the same functions as those of the above-described sheet manufacturing apparatus 100 are denoted by the same reference numerals, and a detailed description thereof will be omitted.

The sheet manufacturing apparatus 200 differs from the above-described sheet manufacturing apparatus 100 in that the sheet manufacturing apparatus 200 has a humidifying portion 202 as illustrated in FIG. 5. The humidifying portion 202 supplies humidified gas to the coarse crushing portion 12. In the illustrated example, a portion of the coarse crushing portion 12 and the supply portion 10 is stored in the storage portion 203. The humidifying portion 202 can supply the humidified gas into the storage portion 203 and humidify the coarse crushing portion 12. In the illustrated example, the first portion 2*a* of the pipe 2 extends from the inside of the storage portion 203 to the outside of the storage portion 203.

The humidifying portion 202 may be a vaporization type in which wind is sent to a filter infiltrated with water or the like, water or the like is vaporized and humidified, an ultrasonic mist type of humidifying by ultrasonic mist, and a heating evaporation type in which water or the like is evaporated by heating and humidified. The relative humidity of the gas humidified by the humidifying portion 202 is, for example, 40% or more, and preferably 60%. The relative humidity of the gas humidified by the humidifying portion 202 is preferably such that the coarse crushing portion 12 does not condense.

The sheet manufacturing apparatus 200 has the humidifying portion 202 for supplying the humidified gas to the coarse crushing portion 12. Therefore, in the sheet manufacturing apparatus 200, drying of the coarse crushed piece cut by the coarse crushing blade 14 can be suppressed. As a result, in the sheet manufacturing apparatus 200, it is possible to more reliably suppress the adhesion of the coarse crushed piece to the shooter 16 due to the electrostatic force.

2.2. Modified Examples of Sheet Manufacturing Apparatus

2.2.1. First Modified Example

Figure 6:
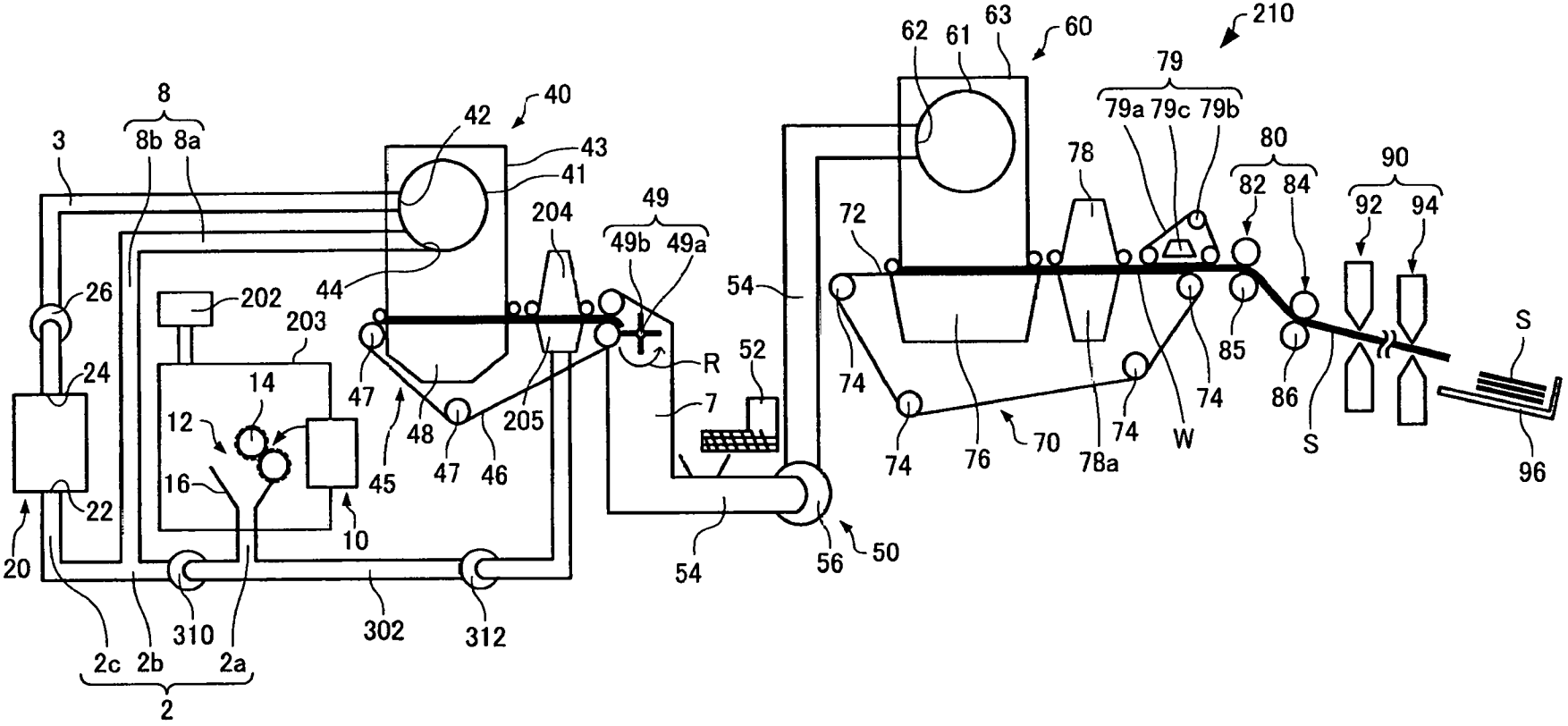
FIG. 6 is a view schematically illustrating a sheet manufacturing apparatus according to a first modified example of the second embodiment.

Next, a sheet manufacturing apparatus according to a first modified example of the second embodiment will be described with reference to the drawings. FIG. 6 is a view schematically illustrating a sheet manufacturing apparatus 210 according to the first modified example of the second embodiment. Hereinafter, in the sheet manufacturing apparatus 210 according to the first modified example of the second embodiment, members having the same functions as those of the above-described sheet manufacturing apparatuses 100 and 200 are denoted by the same reference numerals, and a detailed description thereof will be omitted.

The sheet manufacturing apparatus 210 differs from the above-described sheet manufacturing apparatus 200 in that the sheet manufacturing apparatus 210 has a humidifying portion 204 as illustrated in FIG. 6. The humidifying portion 204 is the humidifying portion 204 for humidifying the defibrated material (first sorted material sorted by the sorting portion 40) that has passed through the opening of the sieve portion 41. In the illustrated example, the humidifying portion 204 humidifies the web V on the mesh belt 46. The humidifying portion 204 is provided above (on the sieve portion 41 side) with respect to the mesh belt 46. The humidifying portion 204 may be the vaporization type, the ultrasonic mist type, or the heating evaporation type.

A suction mechanism 205 is provided below the mesh belt 46 (on the side opposite to the humidifying portion 204 side). The suction mechanism 205 can generate the air flow directed downward (directed from the humidifying portion 204 towards the mesh belt 46). As a result, it is possible to humidify the web V uniformly in the thickness direction.

A pipe 302 is connected to the suction mechanism 205. The pipe 302 forms a supply passage for supplying the gas humidified by the humidifying portion 204 between the coarse crushing portion 12 and the defibrating portion 20 (inside of the pipe 2). The pipe 302 connects the suction mechanism 205 with the pipe 2. In the illustrated example, the pipe 302 is connected to a connection portion between the first portion 2*a* and the second portion 2*b* of the pipe 2. The gas humidified by the humidifying portion 204 passes through the inside of the pipe 302 and reaches the inside of the pipe 2. The relative humidity of the gas humidified by the humidifying portion 204 is, for example, approximately 50%.

In the illustrated example, the pipe 2 is provided with a blower 310. The pipe 302 is provided with a blower 312. The blowers 310 and 312 generate an air flow for supplying the gas humidified by the humidifying portion 204 into the pipe 2.

The sheet manufacturing apparatus 210 has the humidifying portion 204 for humidifying the defibrated material (first sorted material) that passed through the opening of the sieve portion 41. Therefore, in the sheet manufacturing apparatus 210, it is possible to humidify the first sorted material, adhesion of the first sorted material to the mesh belt 46 due to the electrostatic force is weakened, the first sorted material is easily separated from the mesh belt 46, and it is possible to prevent the first sorted material from adhering to the inner wall of the rotating object 49 or the covering portion 63 due to the electrostatic force.

The sheet manufacturing apparatus 210 has the pipe 302 forming the supply passage for supplying the gas humidified by the humidifying portion 204 between the coarse crushing portion 12 and the defibrating portion 20. Therefore, in the sheet manufacturing apparatus 210, the inside of the pipe 2 can be humidified by the gas humidified by the humidifying portion 204. As a result, in the sheet manufacturing apparatus 210, it is possible to prevent the coarse crushed piece passing through the inside of the pipe 2 and the defibrated material from drying and adhering to the inner wall of the pipe 2 due to the electrostatic force. Furthermore, in the sheet manufacturing apparatus 210, the inside of the pipe 2 can be humidified by the gas humidified the first sorted material. As described above, in the sheet manufacturing apparatus 210, the humidified gas can be recycled, and cost reduction can be achieved.

2.2.2. Second Modified Example

Figure 7:
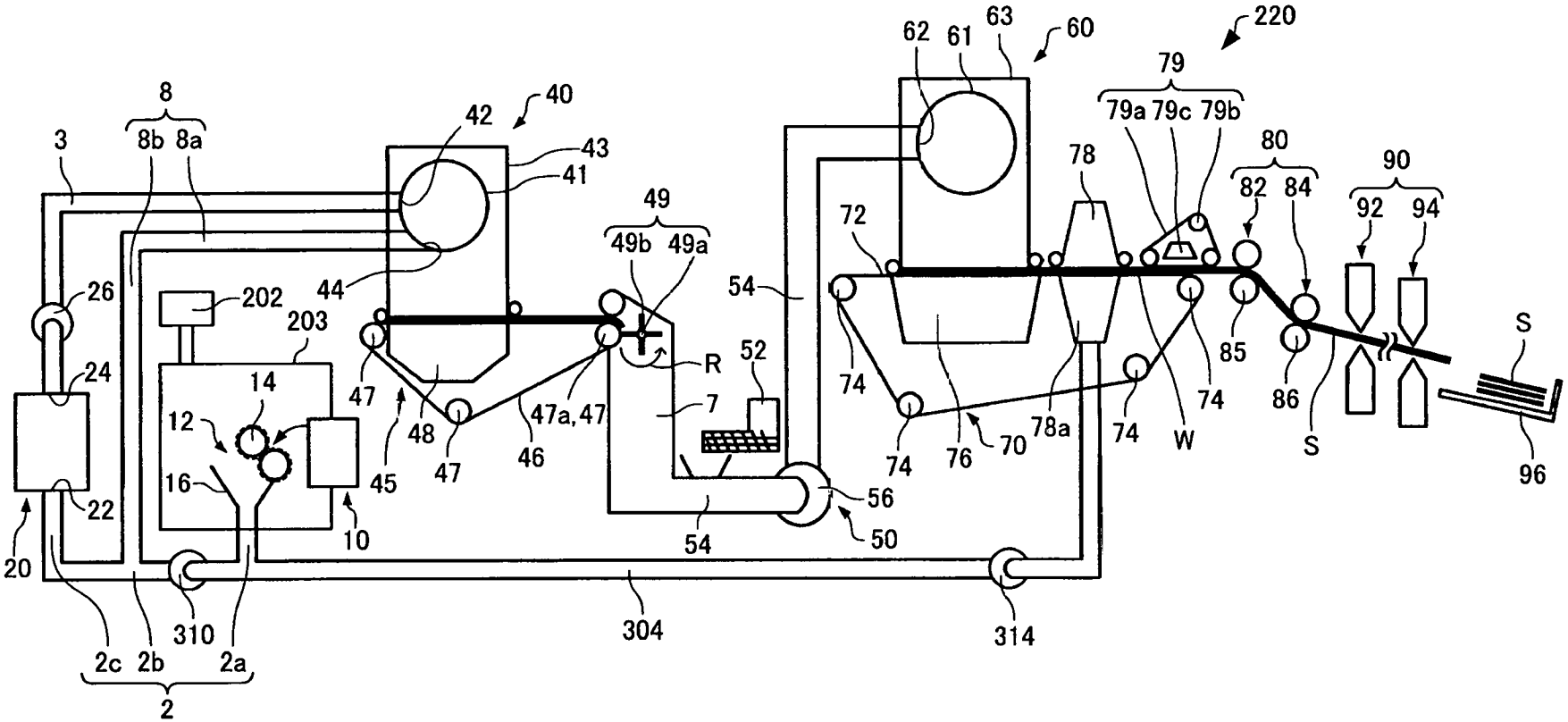
FIG. 7 is a view schematically illustrating a sheet manufacturing apparatus according to a second modified example of the second embodiment.

Next, a sheet manufacturing apparatus according to a second modified example of the second embodiment will be described with reference to the drawings. FIG. 7 is a view schematically illustrating a sheet manufacturing apparatus 220 according to the second modified example of the second embodiment. Hereinafter, in the sheet manufacturing apparatus 220 according to the second modified example of the second embodiment, members having the same functions as those of the above-described sheet manufacturing apparatuses 100, 200, and 210 are denoted by the same reference numerals, and a detailed description thereof will be omitted.

The sheet manufacturing apparatus 220 differs from the above-described sheet manufacturing apparatus 200 in that the sheet manufacturing apparatus 220 has a pipe 304 forming a supply passage for supplying the gas humidified by the humidifying portion 78 between the coarse crushing portion 12 and the defibrating portion 20 (in pipe 2). The pipe 304 connects the suction mechanism 78*a* with the pipe 2. In the illustrated example, the pipe 304 is connected to the connection portion between the first portion 2*a* and the second portion 2*b* of the pipe 2. The gas humidified by the humidifying portion 78 passes through the inside of the pipe 304 and reaches the inside of the pipe 2. The relative humidity of the gas humidified by the humidifying portion 78 is, for example, approximately 50%.

The humidifying portion 78 humidifies an accumulated material accumulated by the accumulation portion 60 (web W in the illustrated example). The accumulation portion 60 accumulates the defibrated material that passed through the opening of the sieve portion 61 on the mesh belt 72 (first sorted material sorted by the sorting portion 40). The humidifying portion 78 may be the vaporization type, the ultrasonic mist type, or the heating evaporation type.

In the illustrated example, the pipe 304 is provided with a blower 314. The blowers 310 and 314 generate an air flow for supplying the gas humidified by the humidifying portion 78 into the pipe 2.

The sheet manufacturing apparatus 220 has the pipe 304 forming the supply passage for supplying the gas humidified by the humidifying portion 78 between the coarse crushing portion 12 and the defibrating portion 20. Therefore, in the sheet manufacturing apparatus 220, the inside of the pipe 2 can be humidified by the gas humidified by the humidifying portion 78. As a result, in the sheet manufacturing apparatus 220, it is possible to prevent the coarse crushed piece passing through the inside of the pipe 2 and the defibrated material from drying and adhering to the inner wall of the pipe 2 due to the electrostatic force. Furthermore, in the sheet manufacturing apparatus 220, the inside of the pipe 2 can be humidified by the gas humidified the web W. As described above, in the sheet manufacturing apparatus 220, the humidified gas can be recycled, and cost reduction can be achieved.

2.2.3. Third Modified Example

Figure 8:
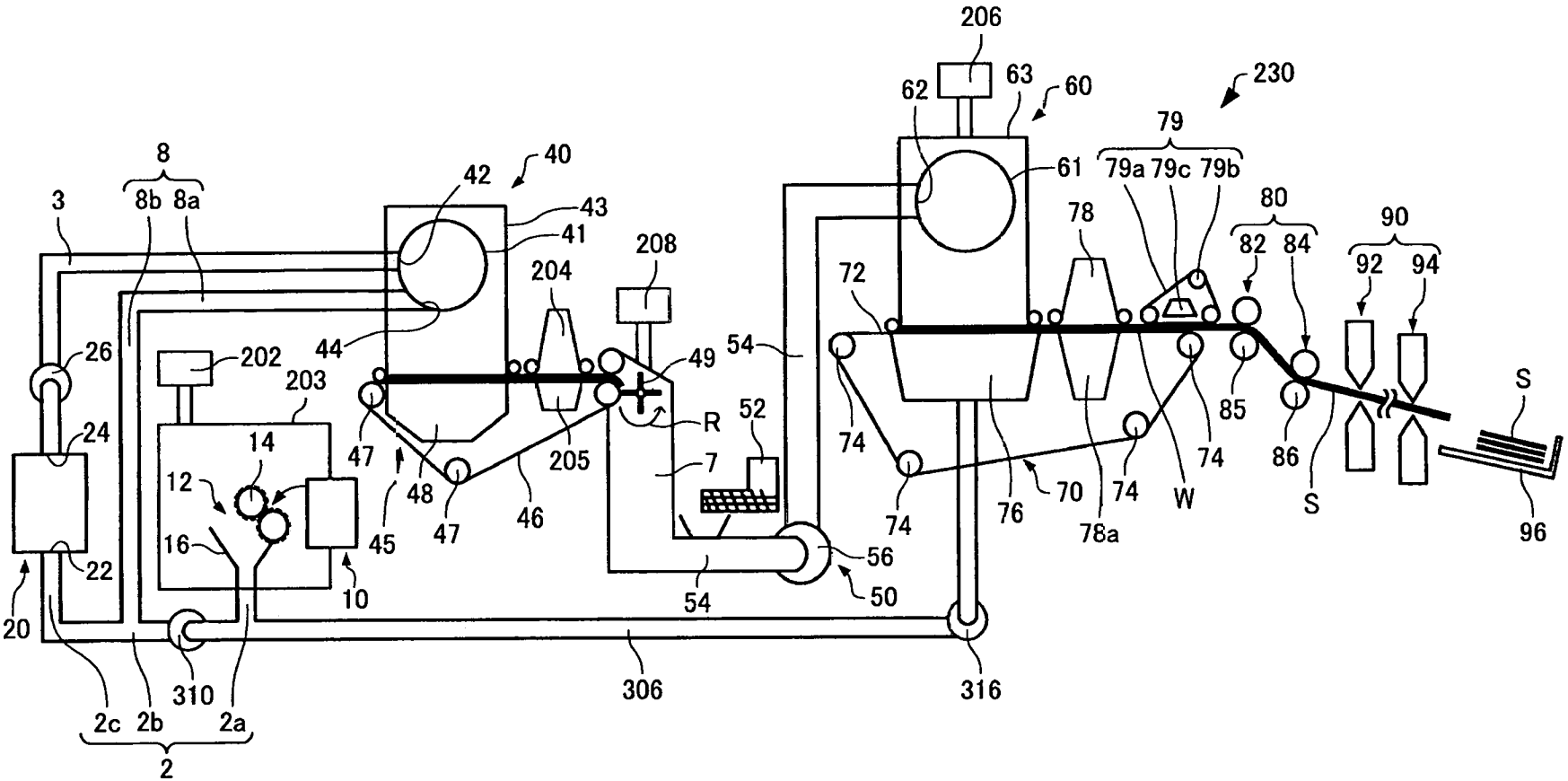
FIG. 8 is a view schematically illustrating a sheet manufacturing apparatus according to a third modified example of the second embodiment.

Next, a sheet manufacturing apparatus according to a third modified example of the second embodiment will be described with reference to the drawings. FIG. 8 is a view schematically illustrating a sheet manufacturing apparatus 230 according to the third modified example of the second embodiment. Hereinafter, in the sheet manufacturing apparatus 230 according to the third modified example of the second embodiment, members having the same functions as those of the above-described sheet manufacturing apparatuses 100, 200, 210, and 220 are denoted by the same reference numerals, and a detailed description thereof will be omitted.

The sheet manufacturing apparatus 230 differs from the above-described sheet manufacturing apparatus 200 in that the sheet manufacturing apparatus 230 has humidifying portions 204, 206, and 208 as illustrated in FIG. 8.

The humidifying portion (first humidifying portion) 206 humidifies the inside of the covering portion 63 of the accumulation portion 60. The covering portion 63 covers at least a portion of the sieve portion 61. The humidifying portion 206 may be the vaporization type, the ultrasonic mist type, or the heating evaporation type. The suction mechanism 76 can generate the air flow directed downward (directed from the humidifying portion 206 towards the mesh belt 72). As a result, it is possible to humidify the web W uniformly in the thickness direction.

A pipe 306 is connected to the suction mechanism 76. The pipe 306 forms a supply passage for supplying the gas humidified by the humidifying portion 206 between the coarse crushing portion 12 and the defibrating portion 20 (inside of the pipe 2). The pipe 306 connects the suction mechanism 76 with the pipe 2. In the illustrated example, the pipe 306 is connected to a connection portion between the first portion 2*a* and the second portion 2*b* of the pipe 2. The gas humidified by the humidifying portion 206 passes through the inside of the pipe 306 and reaches the inside of the pipe 2. The relative humidity of the gas humidified by the humidifying portion 206 is, for example, approximately 55%.

In the illustrated example, the pipe 306 is provided with a blower 316. The blowers 310 and 316 generate an air flow for supplying the gas humidified by the humidifying portion 206 into the pipe 2.

The humidifying portion (fourth humidifying portion) 208 introduces the humidified gas into the pipe 7. The pipe 7 forms a transport passage (second transport passage) for transporting the first sorted material sorted by the sorting portion 40 to the accumulation portion 60. The humidifying portion 208 may be the vaporization type, the ultrasonic mist type, or the heating evaporation type.

The sheet manufacturing apparatus 230 has the pipe 306 forming the supply passage for supplying the gas humidified by the humidifying portion 208 between the coarse crushing portion 12 and the defibrating portion 20. Therefore, in the sheet manufacturing apparatus 230, the inside of the pipe 2 can be humidified by the gas humidified by the humidifying portion 208. As a result, in the sheet manufacturing apparatus 230, it is possible to prevent the coarse crushed piece passing through the inside of the pipe 2 and the defibrated material from drying and adhering to the inner wall of the pipe 2 due to the electrostatic force. Furthermore, in the sheet manufacturing apparatus 230, the inside of the pipe 2 can be humidified by the gas humidified the web W. As described above, in the sheet manufacturing apparatus 230, the humidified gas can be recycled, and cost reduction can be achieved.

The sheet manufacturing apparatus 230 has the humidifying portion 208 for introducing the humidified gas into the pipe 7. Therefore, in the sheet manufacturing apparatus 230, the inside of the pipe 7 can be humidified by the gas humidified by the humidifying portion 208. As a result, in the sheet manufacturing apparatus 230, for example, it is possible to prevent the defibrated material from adhering to the rotating object 49 located in the pipe 7 due to the electrostatic force.

In the sheet manufacturing apparatus 230, unlike the above-described sheet manufacturing apparatus 210 (refer to FIG. 6), the gas humidified by the humidifying portion 204 is not supplied into the pipe 2. This is because the paper dust generated from the web V is prevented from being supplied to the pipe 2 by the gas humidified by the humidifying portion 204.

2.2.4. Fourth Modified Example

Figure 9:
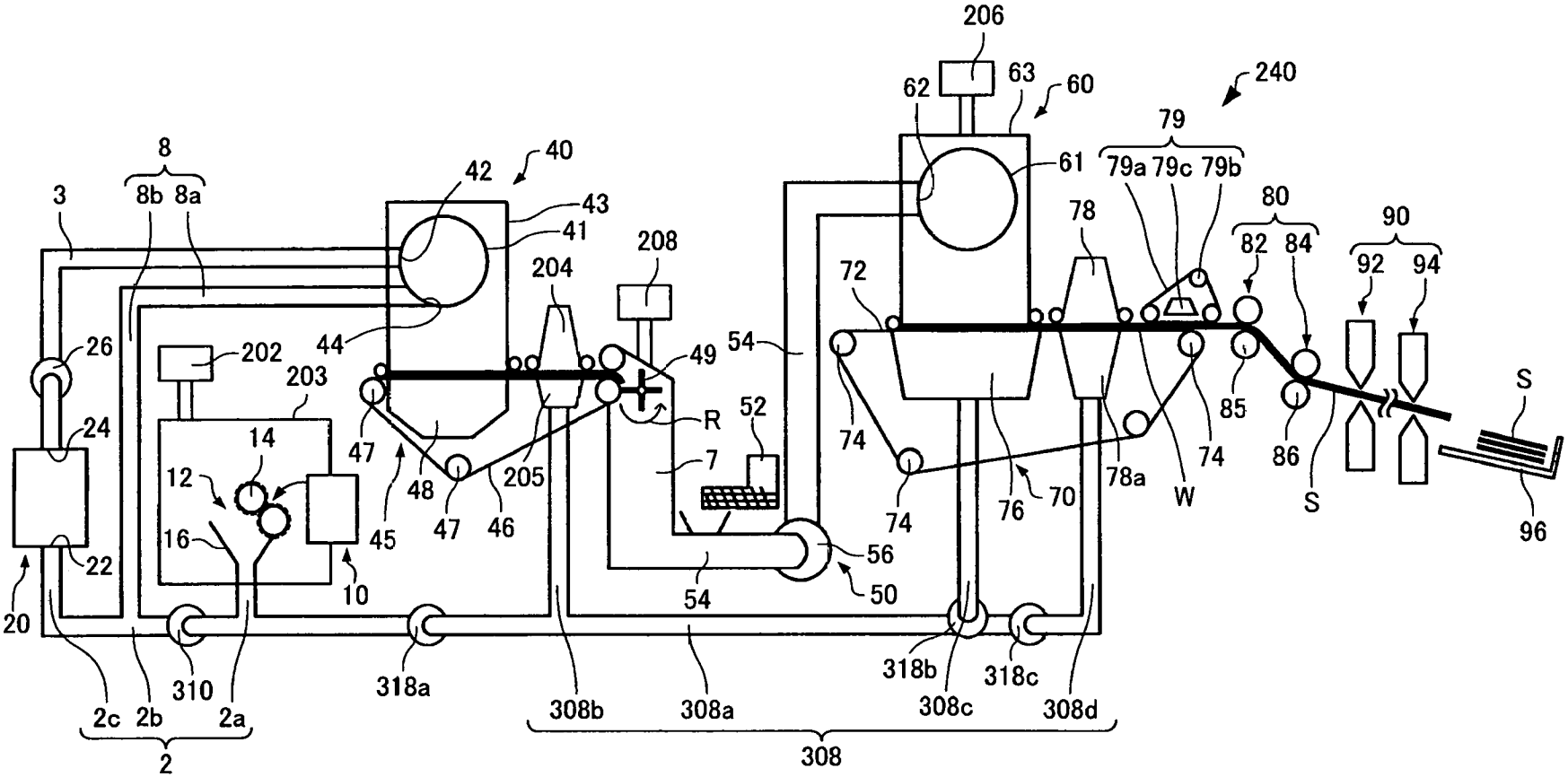
FIG. 9 is a view schematically illustrating a sheet manufacturing apparatus according to a fourth modified example of the second embodiment.

Next, a sheet manufacturing apparatus according to a fourth modified example of the second embodiment will be described with reference to the drawings. FIG. 9 is a view schematically illustrating a sheet manufacturing apparatus 240 according to the fourth modified example of the second embodiment. Hereinafter, in the sheet manufacturing apparatus 240 according to the fourth modified example of the second embodiment, members having the same functions as those of the above-described sheet manufacturing apparatuses 100, 200, 210, 220, 230 are denoted by the same reference numerals, and a detailed description thereof will be omitted.

The sheet manufacturing apparatus 240 differs from the above-described sheet manufacturing apparatus 200 in that the sheet manufacturing apparatus 240 has the humidifying portions 204, 206, 208, and a pipe 308 as illustrated in FIG. 9. The pipe 308 connects the pipe 2 with the suction mechanisms 76, 78*a*, and 205. The pipe 308 forms a supply passage for supplying the gas humidified by the humidifying portion 206 (first humidifying portion), the gas humidified by the humidifying portion 204 (second humidifying portion), and the gas humidified by the humidifying portion 78 (third humidifying portion) between the coarse crushing portion 12 and the defibrating portion 20 (in pipe 2)

In the illustrated example, the pipe 308 has a sixth portion 308*a* extending in the horizontal direction, a seventh portion 308*b* connecting the sixth portion 308*a* with the suction mechanism 205, an eighth portion 308*c* connecting the sixth portion 308*a* with the suction mechanism 76, and a ninth portion 308*d* connecting the sixth portion 308*a* with the suction mechanism 78*a*. The sixth portion 308*a* is connected to the pipe 2 (connection portion between the first portion 2*a* and the second portion 2*b* of the pipe 2 in the illustrated example). The portions 308*b*, 308*c*, and 308*d* extend in the vertical direction. The seventh portion 308*b* supplies the gas humidified by the humidifying portion 204 into the sixth portion 308*a*. The eighth portion 308*c* supplies the gas humidified by the humidifying portion 206 into the sixth portion 308*a*. The ninth portion 308*d* supplies the gas humidified by the humidifying portion 78 into the sixth portion 308*a*.

In the illustrated example, the pipe 308 is provided with blowers 318*a*, 318*h*, and 318*c*. The blowers 310, 318*a*, 318*b*, and 318*c* generate an air flow for supplying the gas humidified by the humidifying portion 78, 204, and 206 into the pipe 2.

In the sheet manufacturing apparatus 240, the pipe 308 forms a supply passage for supplying the gas humidified by the humidifying portion 78, the gas humidified by the humidifying portion 204, and the gas humidified by the humidifying portion 206, between the coarse crushing portion 12 and the defibrating portion 20. Therefore, in the sheet manufacturing apparatus 240, it is possible to humidify the inside of the pipe 2 by the gas humidified by the humidifying portions 78, 206, and 208. As a result, in the sheet manufacturing apparatus 240, it is possible to further reliably prevent the coarse crushed piece passing through the inside of the pipe 2 and the defibrated material from drying and adhering to the inner wall of the pipe 2 due to the electrostatic force.

The sheet S manufactured by the sheet manufacturing apparatus according to the present invention mainly refers to a sheet formed into a sheet shape. However, the sheet S is not limited to a sheet shape, and may be in the form of a board or a web. The sheet in the specification is divided into a paper and nonwoven fabrics. The paper includes an aspect in which from pulp or waste paper as a raw material is formed into a thin sheet, and includes a recording paper for writing or printing, a wallpaper, a wrapping paper, a colored paper, a drawing paper, Kent paper, and the like. The nonwoven fabrics are thicker nonwoven fabrics than paper or low-strength nonwoven fabrics, and include general nonwoven fabrics, a fiber board, a tissue paper (tissue paper for cleaning), a kitchen paper, a cleaner, a filter, a liquid (waste ink and oil) absorbent material, a sound absorbing material, a heat insulating material, a cushioning material, a mat, and the like. As raw materials, vegetable fibers such as cellulose, chemical fibers such as polyethylene terephthalate (PET), polyester, animal fibers such as wool and silk may be used.

The present invention may omit a portion of the configuration within a range having the features and effects described in this application, or combine each embodiment and modified example. For example, in the sheet manufacturing apparatuses 200, 210, 220, 230, and 240, the pipe 2 may have a curved shape like the sheet manufacturing apparatus 110 (refer to FIG. 4). In addition, for example, in the sheet manufacturing apparatus 240, the joint portion of the sixth portion 308*a* with the seventh portion 308*b* of the pipe 308 may have a curved shape like the pipe 2 of the sheet manufacturing apparatus 110, and the joint portion of the sixth portion 308*a* with the eighth portion 308*c* of the pipe

308 may have a curved shape like the pipe 2 of the sheet manufacturing apparatus 110.

The present invention includes substantially the same configuration as the configuration described in the embodiment (for example, configuration having the same function, method, and result, or configuration having the same object and effect). In addition, the present invention includes a configuration in which non-essential parts of the configuration described in the embodiment are replaced. In addition, the present invention includes a configuration that achieves the same operation and effect as the configuration described in the embodiment, or a configuration that can achieve the same object. In addition, the present invention includes a configuration in which a known technique is added to the configuration described in the embodiment.

The entire disclosure of Japanese Patent Application No: 2016-029094, filed Feb. 18, 2016 is expressly incorporated by reference herein.

REFERENCE SIGNS LIST

2 pipe
2*a* first portion
2*b* second portion
2*c* third portion
2*d* introduction port
3, 7, 8 pipe
8*a* fourth portion
8*b* fifth portion
9 shooter
10 supply portion
11 subdivided object
12 coarse crushing portion
14 coarse crushing blade
16 shooter
20 defibrating portion
22 introduction port
24 discharge port
26 blower
40 sorting portion
41 drum portion
42 introduction port
43 housing portion
44 discharge port
45 first web forming portion
46 mesh belt
47, 47*a* stretching roller
48 suction portion
49 rotating object
49*a* base portion
49*b* projection portion
50 mixing portion
52 additive supply portion
54 pipe
56 blower
60 accumulation portion
61 drum portion
62 introduction port
63 housing portion
70 second web forming portion
72 mesh belt
74 stretching roller
76 suction mechanism
78 humidity conditioning portion
78*a* suction mechanism
79 transport portion
79*a* mesh belt
79*b* stretching roller
79*c* suction mechanism
80 sheet forming portion
82 pressing portion
84 heating portion
85 calendar roller
86 heating roller
90 cutting portion
92 first cutting portion
94 second cutting portion
96 discharge portion
100 sheet manufacturing apparatus
102 separation portion
104 fixing plate
105 air flow generation portion
106 detection portion
108 control portion
110, 200 sheet manufacturing apparatus
202 humidifying portion
203 storage portion
204 humidifying portion
205 suction mechanism
206 humidifying portion
210, 220, 230, 240 sheet manufacturing apparatus
302, 304, 306, 308 pipe
308*a* sixth portion
308*b* seventh portion
308*c* eighth portion
308*d* ninth portion
310, 312, 314, 316, 318*a*, 318*b*, 318*c* blower

The invention claimed is:

1. A sheet manufacturing apparatus comprising:
a shredder that crushes a raw material containing a fiber into coarse crushed pieces;
a defibrator that defibrates the coarse crushed pieces into defibrated material;
a sieve portion that includes a plurality of openings;
a sheet forming portion, including a pair of calender rollers and a heater, that presses and heats defibrated material that has been defibrated at the defibrator and has passed through the plurality of openings to form a sheet;
a first pipe through which the coarse crushed pieces passes, the first pipe connecting the shredder to the defibrator;
a second pipe that defines a transport passage that transports defibrated material which has been defibrated at the defibrator and has not passed through the plurality of openings, the second pipe connecting the sieve portion to the first pipe;
a humidifier that humidifies the defibrated material that has been defibrated at the defibrator and has passed through the plurality of openings; and
a supply pipe that defines a supply passage that supplies gas humidified by the humidifier to inside of the first pipe.

2. The sheet manufacturing apparatus according to claim 1, further comprising:
an additional humidifier that supplies humidified gas to the shredder.

3. The sheet manufacturing apparatus according to claim 1, further comprising:
a drum sieve that accumulates the defibrated material that has been defibrated at the defibrator and has passed through the plurality of openings, wherein
the humidifier humidifies an accumulated material accumulated by the drum sieve.

4. A sheet manufacturing apparatus comprising:

a shredder that crushes a raw material containing a fiber into coarse crushed pieces;

a defibrator that defibrates the coarse crushed pieces into defibrated material;

a first drum sieve that sorts the defibrated material into a first sorted material and a second sorted material;

a second drum sieve that accumulates the first sorted material sorted by the first drum sieve;

a housing that covers at least a portion of the second drum sieve;

a sheet forming portion, including a pair of calender rollers and a heater, that presses and heats an accumulated material accumulated by the second drum sieve to form a sheet;

a connecting pipe through which the coarse crushed pieces passes, the connecting pipe connecting the shredder to the defibrator;

a first transport pipe that defines a first transport passage that transports the second sorted material sorted by the first drum sieve, the first transport pipe connecting the first drum sieve to the connecting pipe;

a first humidifier that humidifies an inside of the housing; and a supply pipe that defines a supply passage that supplies gas humidified by the first humidifier to inside of the connecting pipe.

5. The sheet manufacturing apparatus according to claim 4, further comprising:

a second humidifier that humidifies the first sorted material sorted by the first drum sieve; and a third humidifier that humidifies the accumulated material accumulated by the second drum sieve, wherein the supply passage is a supply passage which supplies gas humidified by the first humidifier, gas humidified by the second humidifier, and gas humidified by the third humidifier to inside of the connecting pipe.

6. The sheet manufacturing apparatus according to claim 4, further comprising:

a second transport pipe that defines a second transport passage that transports the first sorted material sorted by the first drum sieve to the second drum sieve; and a fourth humidifier that introduces humidified gas into the second transport passage.

* * * * *